US006319179B1

(12) United States Patent
Hinds

(10) Patent No.: US 6,319,179 B1
(45) Date of Patent: Nov. 20, 2001

(54) SINGLE SPINE ELASTIC CORD EXERCISE ASSEMBLY

(76) Inventor: Robert Sylvester Hinds, 1803 Regent St., Madison, WI (US) 53703

( * ) Notice: Subject to any disclaimer, the term of this patent is extended or adjusted under 35 U.S.C. 154(b) by 0 days.

(21) Appl. No.: 09/222,585

(22) Filed: Dec. 28, 1998

(51) Int. Cl.[7] ..... A63B 21/04
(52) U.S. Cl. ..... 482/121; 482/123; 482/94
(58) Field of Search ..... 482/23, 121–130, 482/907, 904, 126

(56) References Cited

U.S. PATENT DOCUMENTS

| | | |
|---|---|---|
| 232,579 | 9/1880 | Weeks . |
| D. 277,218 | 1/1985 | Hinds . |
| 1,112,114 | 9/1914 | Caines . |
| 1,965,511 | 7/1934 | Preston . |
| 3,430,953 | 3/1969 | Teetor . |
| 3,847,422 | 11/1974 | Gulistan . |
| 3,956,911 | 5/1976 | Carboud . |
| 3,984,136 | 10/1976 | Bills . |
| 4,018,437 | 4/1977 | LoPresti . |
| 4,109,907 | 8/1978 | Zito . |
| 4,113,221 | 9/1978 | Wehner . |
| 4,182,510 | 1/1980 | Lundell . |
| 4,185,816 | 1/1980 | Bernstein . |
| 4,212,458 | 7/1980 | Bizilia . |
| 4,412,677 | 11/1983 | Viramontes . |
| 4,419,990 | 12/1983 | Forster . |
| 4,662,629 | 5/1987 | Plovie . |
| 4,779,867 | 10/1988 | Hinds . |
| 4,787,626 | 11/1988 | Gallagher . |
| 4,809,971 | 3/1989 | Goldish . |
| 4,848,741 | 7/1989 | Hermanson . |
| 4,944,518 | 7/1990 | Flynn . |
| 5,135,445 | 8/1992 | Christensen et al. . |
| 5,176,602 | 1/1993 | Roberts . |
| 5,342,274 | 8/1994 | Hunker . |
| 5,354,253 | 10/1994 | Awbrey et al. . |
| 5,431,617 | 7/1995 | Rattray, Jr. . |
| 5,505,677 | 4/1996 | Hinds . |
| 5,514,059 | 5/1996 | Rumney . |
| 5,540,643 | 7/1996 | Fontaine . |
| 5,549,532 | 8/1996 | Kropp . |
| 5,571,064 | 11/1996 | Holm . |
| 5,626,546 | 5/1997 | Little . |

FOREIGN PATENT DOCUMENTS

| | | |
|---|---|---|
| 27611 | of 1899 | (GB) . |
| 116404 | of 1900 | (GB) . |

*Primary Examiner*—Jerome Donnelly
(74) *Attorney, Agent, or Firm*—Loyd W. Bonneville

(57) ABSTRACT

A single channel spine elastic cord exercising assembly optionally capable of mounting upon the face of a door without inflicting damage upon it and comprising bilateral tension spreading means comprising spring loaded pin latches as means of height adjustment; anchoring pins in conjunction with tethering hooks and pulley assemblies which facilitate reestablishing exercise tethering points by the operator; together with accessories including an operator stabilization bar.

18 Claims, 7 Drawing Sheets

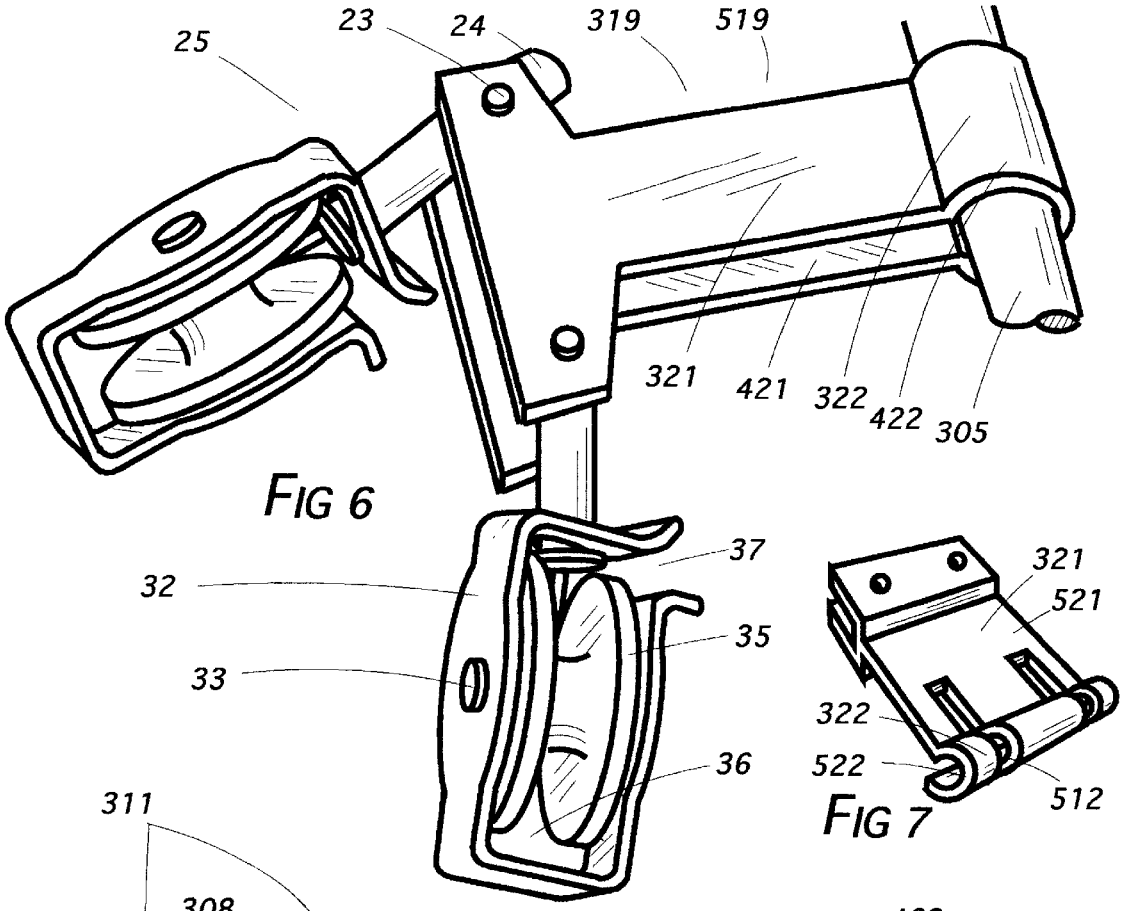
FIG 6
FIG 7
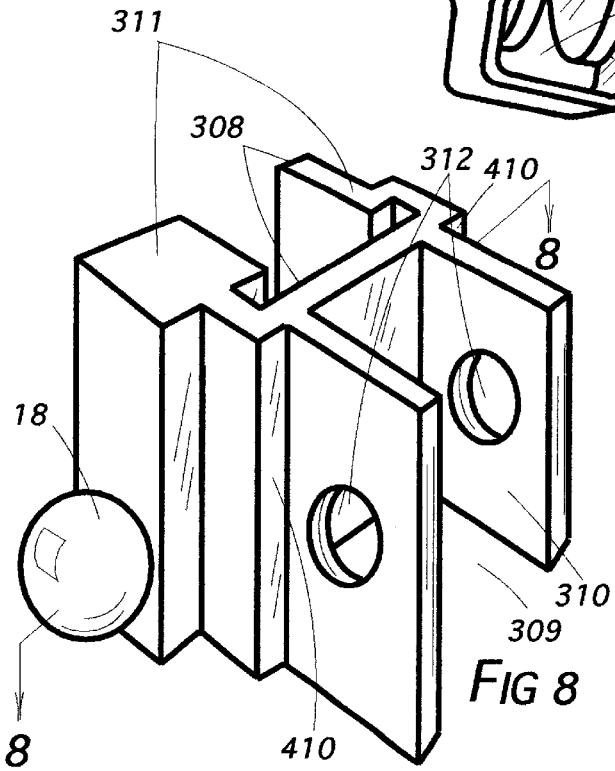
FIG 8
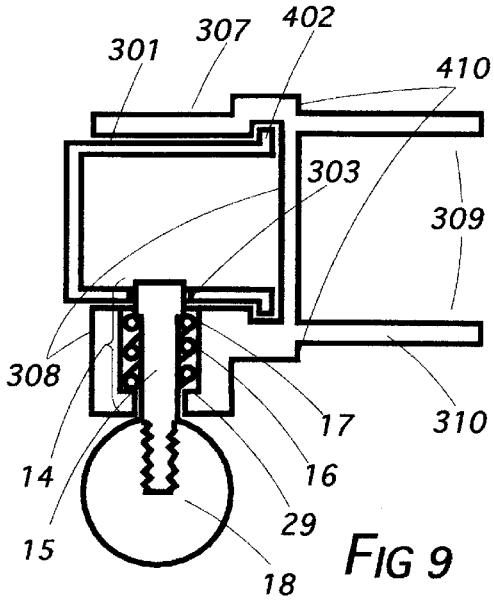
FIG 9

SINGLE SPINE ELASTIC CORD EXERCISE ASSEMBLY

BACKGROUND OF THE INVENTION

1. Field of the Invention

Gymnastic devices

2. Description of the Peior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term bilateral exercise tension director (319) might be used in one instance but in another, if meaning is otherwise clear from context, expression might be shortened to bilateral tension director (319) or merely bilateral director (319). Any of those forms is intended to convey the same meaning.

The term emplace or any of its forms when used in this application means the joining of two objects or parts so as to unite them in a reasonably easily removable way, such as the fitting of a length of elastic exercise cord (27) within a pulley wheel's circumferential groove (36) from which it (27) may be removed, discussed ante.

Where the term is employed, rigid emplacement connotes the meaning that the object is removable but only with some degree of difficulty, such as might be encountered in separating two parts—for example, an aperture engaging pin (15) from a channel spine latching aperture (303) in which it (15) is held in position by expansion of a spring (16). The word emplace is also consistent in meaning with the word "detachable" as occasionally used in connection parlance but not in this application, since it is derived from the root attach. The term attach or fasten or any of their forms when so used means that the juncture is of a more or less permanent nature, such as might be accomplished by nails, screws, welds or adhesives. Employment of the words connect or join or any of their forms is intended to include the meaning of both in a more general way.

The word comprise may be construed in either of two ways herein. A generic term used to describe a given one of a number of specific elements is said to comprise it, thereby characterizing the specific element with equivalency for the generic term. Thus, a bilateral exercise tension director (319) may be said to comprise a vertically disposed tethering hook (419), meaning that in the particular case, the bilateral tension director (319) is a tethering hook (419). However, the word comprise may also be used to describe a feature which is part of the structure or composition of a given element. Thus, a horizontally emplaced anchoring pin (305) may be said to comprise an emplacement groove (412), meaning that the structure of the pin (305) is such as to have the emplacement groove (412) as a feature of its structure. The meaning in the respective cases is clear from context, however. Accordingly, modifying words to clarify which of the two uses is the intended one seem unnecessary.

The word multiply or any of its derivatives is also employed in two different ways, either as a verb or an adjective. Thus, it is explained herein that the number of tethering point (300) arrangements is multiplied by reason of the number of axes of rotation a pulley assembly (519) comprises—the verb sense, in that the assembly's diversity permits an operator (200) to multiply the number of setups he or she elects to exercise from. Used as an adjective, however, it is said herein that a multiply elbowed door connection bracket (52) comprises door edge wrapping configuration (54)—meaning merely that it (52) is shaped with a number of elbows exceeding that of an alternative embodiment.

There is a distinct difference between exercising assemblies which employ weights attached to inelastic cords (27) strung through a pulley and those which employ a length of elastic cord (27) tethered from a given point. As an operator (200) pulls upon an inelastic cord (27) to which a weight is attached, sufficient initial effort must be expended to overcome the weight's resting inertia. As the effort continues and the weight gathers momentum, less effort is required. Even after the effort is terminated, the weight continues for a short distance in its path, reaches maximum height and then begins to fall, pulling the cord (27) with it, in response to gravity. It is sometimes said to have "gone ballistic".

The tension exerted upon an elastic cord (27) as it is stretched, increases beginning from its initial state of rest completely up to the point of maximum effort. The cord (27) immediately begins retracting upon reversing the effort. Many consider the acceleration gradient imposed by an elastic cord (27) to be highly beneficial.

Weights also have other disadvantages such as the noise they create during use, the necessity to store them to avoid clutter and the inconvenience of having to change them for one's different exercises or accommodate an additional exercising operator. Employing proper equipment, elastic cords (27) of lesser or greater resistance and strung upon a tethered exercise tension system may be easily changed, or alternatively, left in place by a first operator (200) without interfering with the efforts of a second one (200) who uses an independently tethered cord (27) of different resistance.

Elastic cord (27) assemblies have traditionally been attached to a wall (106) to provide what are referred to herein as exercise tethering points (300). However, many people have limited wall (106) space available for such installation. The bulky character of the traditional exercise assemblies and the want of sufficient installation space for them have led to portable models which provide for various isometric or isotonic exercises. While portability avoids installation problems and enables use away from home, many feel there is no real substitute for an anchoring vertical surface mounted construction.

There has been a growing interest in tethering exercise equipment to a less obtrusive locale such as upon a household door (100) during a time it is not otherwise required for ingress and egress.

Assemblies intended for doorway (103) use have taken a variety of forms. Some have been anchored upon the doorway's (103) encircling woodwork. That portion of an assembly which might otherwise interfere with those passing through it should be easily removable after exercise.

Some of the portable models, supra, have been configured with door (100) blockers or similar obstructions usually taking the form of thickened straps which are fitted through the margin or crack around the door's (100) perimeter such that they don't pull through when exercise tension is operably applied. Those models are referred to herein as comprising door stop or door impingement features, ante. As useful as those assemblies are, their tethering source is necessarily limited to the doorway's (103) perimeter. Efforts to provide for more centralized exercise tethering have contributed to development of door face (101) installation assemblies.

An assembly mounted upon the face (101) of a door (100) should be constructed so as not to damage it (100). Bolts driven into or through the door (100) leave unsightly holes when the assembly is removed. Some of the portable exercisers, supra, provide secure tethering with devices shaped to fit around the edge (102) of a closed door (100) at the top or bottom thereof (100). Those models are referred to herein as comprising door edge wrapping configurations. Some of the devices comprise a nonpenetrating bolt and plate to enhance security. Others are constructed for such purpose in a manner to insure that the fit is snug.

Once a vertical supporting spine has been erected, means for dividing the tension to both the right and left sides may be emplaced upon it. Such means usually comprise either a vertically disposed rod segment, hook, eyelet or pulley assembly disposed at the tethering point (300). On a traditional assembly upon which pulleys are employed, they are often connected at a fixed site from a hook or ring. They should be configured to permit positioning at a desired height before exercise is undertaken so as to quickly and easily provide selected tethering points (300). They should also be configured to provide a sufficient number of pivot sites to allow rapid variations in tension and orientation without impeding their operation. Thus, the tension dividing means, whatever form it may comprise should be configured so that it can be emplaced upon an overhead projection rather than merely connected to a wall or other supporting structure.

Where a pulley system is employed, the means by which it is connected should comprise shape which permits it to pivot vertically upon its connection point when subjected to various exercise tensions. It should comprise capability to allow the pulley wheel to spin in response to forces imposed upon it by the elastic cord (27) without allowing the cord itself to become twisted and should, therefore, comprise numerous axes of rotation.

A pulley assembly should also be configured to permit quick and easy emplacement of the elastic cord (27) upon a pulley wheel without risk of the cord's (27) dislodgement from the assembly.

Means for height adjustments should comprise pin latching mechanisms operable with minimum effort. Certain features of pin and aperture connections along a vertical spine occasionally employed in the past might still be useful if additionally provided with quick release features combined with firm channel locking capability to prevent accidental dislodgement.

An assembly should also comprise sufficient versatility by reason of interchangeability of its parts to permit mounting at either of the preferred locales mentioned supra—that is, upon the wall (106) or upon a door's face (101)—and yet allow for exercise away from home with those parts thereof which lend themselves to portability, such as the elastic cords (27), handgrips (28) and any door impingement devices available as accessories.

U.S. Pat. No. 232,579 issued to Weeks features an early wall (106) tethered exercise assembly, comprising handgrips as operator manipulators, pulleys and lengths of both elastic and inelastic cords (27). U.S. Pat. No. 1,112,114 issued to Caines also comprises a relatively early wall anchored elastic cord (27) system. A subsequent such assembly is featured in U.S. Pat. No. 1,965,511 issued to Preston. U.S. Pat. No. 5,431,617 issued to Rattray, Jr. represents a more recent wall (106) tethered exercise assembly wherein several elastic cords (27) are simultaneously employed. The assembly in U.S. Pat. No. 5,626,546 issued to Little invokes a wall (106) mounted framework of paired vertical spines comprising aperture engaging pins and spaced apertures disposed along the sides of the spines for tethering height adjustment by means of simple channel engagement pins secured with cotter pins, the assembly comprising handgrips, pulleys and elastic cords (27) as well.

U.S. Pat. No. 5,176,602 issued to Roberts also employs handgrips, pulleys and elastic cord (27) as do the foregoing. While the patent focuses upon door (100) stop or door (100) impingement tethering, instructions are included therein to mount a rigid framework comprising spaced apertures upon the walls (106) in the corner of a room, the apertures providing tethering points (300) for apparatus connecting links. U.S. Pat. No. 4,848,741 issued to Hermanson illustrates a special framework upon which several pulley wheels are mounted in a selected pattern which permits lengthening or shortening the elastic cord (27) to vary the tethering tension. U.S. Pat. No. 5,354,253 issued to Awbrey features an adjustable framework for underwater exercise also comprising spaced apertures, position adjusting brackets and simple pins secured by either cotter pins or nuts, although there is no specific reference to use of elastic cord (27).

Patents featuring elastic cord (27) assemblies but employing door (100) stop or door (100) impingement tethering include U.S. Pat. No. 4,779,867 and U.S. Pat. No. 5,505,677 both issued to Hinds, U.S. Pat. No. 5,514,059 issued to Rumney, U.S. Pat. No. 5,549,532 issued to Kropp and U.S. Pat. No. 5,571,064 issued to Holm. The Hinds U.S. Pat. No. 5,505,677 supra, provides for enhanced tethering security by looping the anchoring strap around the doorknob. A very early door impingement variation is illustrated by one of the embodiments of Bussey, discussed ante.

Patents employing door edge (102) enwrapment tethering include (Great Britain) G.B. Patent No. 27,611 issued to Bussey, G.B. Patent No. 16,404 issued to Wieland, U.S. Pat. No. 3,430,953 issued to Teetor, U.S. Pat. No. 4,018,437 issued to LoPresti, U.S. Pat. No. 4,109,907 issued to Zito, U.S. Pat. No. 4,182,510 issued to Lundell, U.S. Pat. No. 4,185,816 issued to Bernstein, U.S. Pat. No. 4,212,458 issued to Bizilia, U.S. Pat. No. 4,419,990 issued to Forster, U.S. Pat. No. 4,662,629 issued to Plovie, U.S. Pat. No. 4,787,626 issued to Gallagher, U.S. Pat. No. 4,809,971 issued to Goldish, U.S. Pat. No. 4,944,518 issued to Flynn, U.S. Pat. No. 5,135,445 issued to Christensen, U.S. Pat. No. 5,342,274 issued to Hunker, U.S. Pat. No. 5,540,643 issued to Fontaine and U.S. Pat. No. Des. 277,218 issued to Hinds. Almost all of these constructions include no exercise cord (27) and are suitable only for situps and other exercises of an isotonic character enhanced by bracing a part of the body. Only the Bussey, Wieland and Hunker patents of this category include a length of elastic cord. The LoPresti patent represents one in which opposing elbowed bracing pins comprise an enwrapment structure from which an exercise frame is projected. The Zito patent comprises inelastic cord (27) and weights. U.S. Pat. No. 4,412,677 issued to Viramontes is a chinning bar similar to the foregoing but provides for enwrapment over an exposed joist or garage door of an exposed joist, if available.

Caines and Preston, supra, are worthy of note among the early U.S. forerunners in this sector of interest. The same is true of the British works of Bussey and Wieland. While all employ elasticity as the exercise medium, none comprises a one-piece elastic free running cord such as would be integrated into a wheel and pulley system. While the Bussey device appears at first glance to incorporate a single cord which might be capable of sliding and stretching freely throughout its length, it in fact comprises "cords" attached at their "fast" ends. Even the single cord of Caines is secured at what might otherwise be interpreted as a free-sliding segment thereof. The cord (27) of the more recent Little assembly is similarly attached. While the notion that elasticity could be successfully incorporated in conjunction with one or more wheels or similar pulley devices had long before been demonstrated by Weeks, more extensive development along those lines remained for others including Roberts and Hermanson, supra.

Employing a single running cord (27) provides greater length through which its stretching occurs and, therefore, requires less exercise space within a given room for the same amount of cord stretch (27). Aside from valuable space conservation, this feature facilitates exercise of an aerobic-like character, since greater movement results from a given length of cord stretch (27) than is the case with shorter cords. Those who train seriously understand well the benefits of left and right body-sided reciprocation in which the torso is urged to twist in response to a system's free-running elastic restraints. Attachment of shorter elastic cords (27), of course, also introduces an incidental safety concern in that they could become dislodged from their fastening sites.

Beyond the early beginnings exhibited by Weeks, Caines, Preston, Bussey and Wieland, the task remained of constructing a sophisticated system wherein the midportion of a single cord is quickly strung upon pulley wheels emplaced upon an easily adjusted framework optionally mounted upon a household door.

Patents featuring spring loaded pin latches include U.S. Pat. No. 3,847,422 issued to Gulistan, U.S. Pat. No. 3,956,911 issued to Carboud, U.S. Pat. No. 3,984,136 issued to Bills and U.S. Pat. No. 4,113,221 issued to Wehner. While the spring of the Gulistan assembly is biased outwards, it operates upon the same principal as the inwardly biased ones. Biasing orientation is controlled by the location of the shoulder against which the spring is retracted and the shoulder in this device is merely reversed from that of an inwardly biased spring. The Gulistan pin is retained in nonretracted disposition by interthreading of parts.

An exercise assembly should at least incorporate many of the best features of the cited constructions. As many as there are, however, none of them provide the totality of the modern athlete's requirements. An assembly should, therefore, comprise improved pulley systems and easily operable latching mechanisms. In summary, the needs or objectives pointed out supra thus far remain only partly addressed in the prior art and some have not been met at all.

SUMMARY OF THE INVENTION

The invention comprises an elastic cord (27) exercising assembly capable of installation upon a wall (106) and, of particular significance, upon the face (101) of a door (100) with components which do not scratch or otherwise damage the door's (100) surface. When installed upon a wall (106), a channel spine (301) is attached to solid backing. A stabilizing bar (90) is an optional part of the assembly.

Means for symmetry in left and right tethered exercise motions, designated herein as a bilateral exercise tension director (319), are provided in all embodiments. In the simpler of them, a vertically disposed tethering hook (419) seated within a girdling groove (420) carved within a horizontally disposed anchoring pin (305) serves this purpose.

Channel spine engaging assemblies (307), emplaced upon the spine (301) each (307) comprise in part a spring loaded pin latch assembly (14) comprising in turn an anchoring pin (305). Bilateral exercise tension directors (319), either comprising sets of double pulley assemblies (519), or tethering hooks (419), are connected to the anchoring pins (305). Any of these bilateral exercise tension directors (319) is quickly raised or lowered merely by manipulating its respective channel engaging assembly (307). By reason of a multitude of pin setting apertures (303) in the channel spine (301) with which (301) the spine engaging assemblys' pin latches (14) interconnect, a great number of variations in assembly positioning are available. The most sophisticated of the bilateral exercise tension directors (319), a double pulley assembly (519), provides exceptional exercise movement features. By reason of a combination of four axes of pulley assembly (519) rotation and a multitude of pin seating apertures (303) in the channel spine (301) with which (301) the spine engaging assemblys' pin latches (14) interconnect, the number of variations is considerably multiplied.

For installation upon the face (101) of a door (100), the invention features a surface protection door connection assembly (50) wherein a mounting channel (41) is attached to the channel spine (301) to comprise a channel frame (344) vertically disposed upon the door (100). Two brackets (52, 152) are emplaced at the top and bottom edges of the door (100), respectively, at least the uppermost of which (52) effectually wraps around the edge (102) of the door (100), but both of which (52, 152) engage the channel frame's ends (345). They (52, 152) are configured with elbows to comprise retraction plate properties (59) wherein connecting tension is localized at points not in contact with the door's (100) surface. The configuration of the door surface protection assembly (50) is such as to confer firm connecting strength upon the exercise assembly while avoiding any damage to the door (100).

BRIEF DESCRIPTION OF THE DRAWINGS

Solid lines in the drawings represent the invention. Dashed lines represent prior art.

FIG. 6 depicts a double pulley assembly (519) comprising a double leaf pin tethering leg (321, 521) and illustrating the assembly's (519) four separate pivoting points. The assembly better demonstrates that feature by being shown tilted.

FIG. 7 illustrates a single leaf leg (321, 421) embodiment.

FIGS. 8 and 9 represent a channel spine engaging assembly (307) shown in both perspective and cross sectional views.

DESCRIPTION OF THE PREFERRED EMBODIMENT

Figure 1:
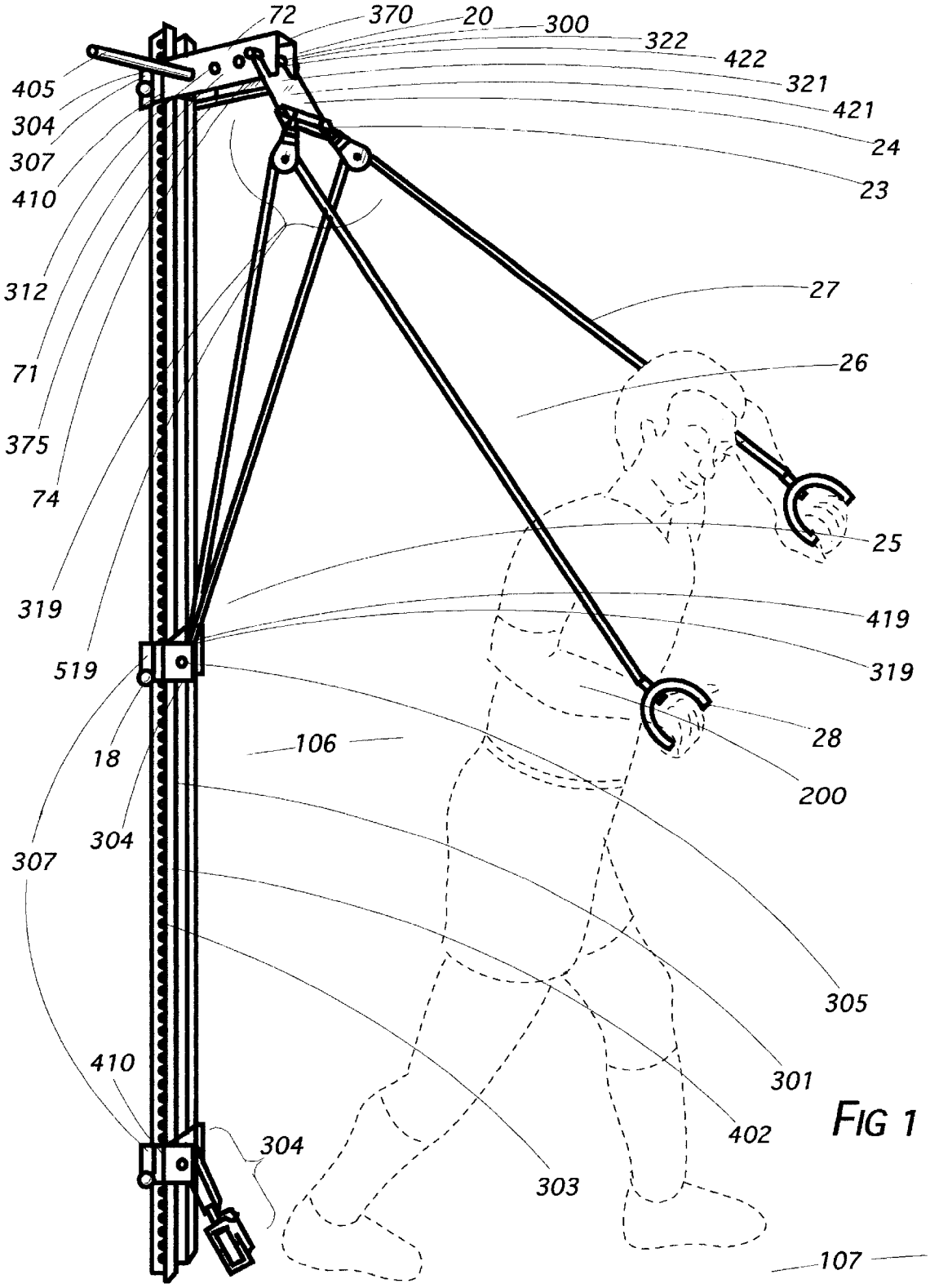
FIGS. 1–3 represent perspective views of the invention, comprising most of the features present when mounted upon a vertically supportive surface such as a wall (106) and illustrating optional arrangements thereof for various exercise postures.

The invention in general comprises an assembly of parts which enhance traditional exercise techniques. Some of the parts are already known to the prior art, while others are new. The invention demonstrates novelty both in a combination of those parts as well as in certain of the individual parts themselves.

The subject of this application is an elastic cord (27) exercising assembly comprising in part a vertically disposed channel spine (301) and a height adjusting channel spine engaging assembly (304). In certain embodiments, a cantilevered tethering projection (370) and double pulley assembly(519) are also featured.

The channel spine itself (301) may take any one of several forms but is already available commercially in very useful embodiments which are easily modified for a manufacturer's particular use.

Many exercise assemblies comprise what is referred to herein as an operator tension manipulating terminal (25)—or, the point on the assembly from which the operator (200) draws tension during exercise. Thus, while a length of elastic exercise cord (27) may run directly to a pulley wheel (35), the tension manipulating terminal (25) is defined herein to be the ultimate point of tension at a point therebeyond at an anchoring pin (305) with which it (25) is either fastened or otherwise originates from. In that connection, it should be understood that a single length of exercise cord (27) may terminate at both the operator's hands or feet—one to the right and the other to the left—but that its (27) midpoint comprises a vertex such as that shown in FIGS. 1–3. It would be an anchoring pin (305) disposed at that vertex, not one (305) proximate the pulley wheel (35) mentioned, which is identified herein as the tension manipulating terminal (25). The locus at which any pulley assembly (519) is connected—intermediate or otherwise—is designated a tethering terminal (20) for that particular assembly (519). The anchoring pin (305) associated with the pulley wheel (35) to which the exercise cord (27) extends directly from the exercising operator (200), and which, therefore, comprises a directional aspect, is identified herein as the exercise tethering point (300).

The stationary part of the assembly is generally constructed upon a vertical surface such as a wall (106) or the face of a door (101). In the former case, the connection is generally made by attachment, preferably by means of screws or bolts, into solidly backed supporting stud type building material. Attachment may also be made into masonry. This application specifically addresses the inherent problem of avoiding damage to the door's face (101) where such is the fixed site for the assembly.

One of the forms the channel spine (301) may take comprises an elongated hollow longitudinally slotted structure, bearing an easily manufactured outwardly disposed clamping lip (402) along each edge of the longitudinal slot as depicted in FIGS. 10–12, 15 and 16. The general shape of this form provides an easily accessible interior convenient for installation of the system and is readily available commercially. The functionality of the clamping lip (402) is further discussed ante. Whatever configuration is employed, it must provide a suitable runner upon which mechanisms mated to its shape, such as the height adjusting channel spine engaging exercise assembly (304) of the subject invention, may be conveniently employed.

The channel spine (301) also comprises spaced latching apertures (303) generally in one side thereof (301) along its (301) entire length. Apertures (303) may be drilled in manufacture into both sides, but since doubling the number thereof (303) could adversely affect the spine's strength, it is preferred they (303) be limited to but one side thereof (301). It should also be understood that because of the spine's (301) longitudinal symmetry, the operator (200) may choose to erect the exercise assembly to dispose the apertures (303) on either side of its sides (301). Right handed individuals may prefer to install the assembly so that the adjusting means to raise and lower the height adjusting channel spine engaging assembly (304) is disposed to the right. Where the supporting surface is a wall (106), the spine (301) is vertically attached directly to it (106). Installation means are further discussed ante.

The terminology spaced latching apertures (303) merely means that any given aperture (303) is distinctly situated a short distance from any adjoining one (303). They (303) must be situated in a straight longitudinal line from one end of the spine (301) to the other thereof (301). For reasons related to aesthetics and economy of manufacture, it is preferable, though not essential, that the distances between adjoining apertures (303) on a spine (301) be equal throughout the entire length thereof (301). The spine's (301) cross section is discussed further ante.

Next introduced as part of the invention is the height adjusting channel engaging exercise assembly (304) alluded to supra. The sliding height adjusting assemblies (304) comprise a channel engaging assembly (307) and a bilateral exercise tension director (319) in all cases and in some, a cantilevered tethering projection (370). The latter two (319, 370) are further discussed ante. The channel engaging assembly (307) in turn comprises pin emplacement sockets (312) into which a horizontally disposed anchoring pin (305) is extended, as further discussed ante.

The height adjusting feature permits the operator (200) to raise and lower the tethering point (300) to a height selected for a particular set of exercises. For example, upon setting an assembly (307) at a high level upon the spine (301), the operator (200) may engage those muscles applied to downward pulling. Adjusting it (307) to mid-level enables forward thrusting motions much in the manner undertaken by a boxer. When lowered toward the bottom, the assembly (307) permits either upward pulling motions by a standing operator (200) or forward thrusts by a one (200) seated upon the floor (107). It should be recognized that a nearly infinite number of intermediate settings provide feasible selections offering exercising nuances preferable in one case or another.

Each spine engaging assembly (307) comprises a channel spine engaging underside (308), upon which channel spine clamping lips (311) are disposed. The spine clamping lips (311) permit the assembly (307) to be slid up or down along the spine (301) in making the adjustment in height. The clamping lips (311) are stated herein to be mated in shape to a channel spine's cross section (302). That means that whatever particular shape that cross section (302) takes, the lips (311) fit fairly closely around each of the spine's (301) protrusions and indentations—sometimes referred to as dislodgement stops—so that the spine engaging assembly (307) cannot be removed in a nonlongitudinal direction. Its (307) emplacement or removal requires sliding it to the spine's (301) end.

The assembly (307), depicted in FIGS. 8 and 9, comprises clamping lips (311) mated to a spine (301) comprising outfolding rather than infolding configuration. The spine (301) is configured as a considerably elongated structure, long enough to extend when employed in wall (106) mounting, for example, almost from the floor (107) to a point almost to the ceiling. A spine (301) comprising infolding configuration is shaped more or less in rectangular cross section with a slot disposed lengthwise along its (301) length so as to dispose inwardly oriented flanges or ridges referred to herein as clamping lips (402) along each side. A spine comprising outfolding configuration is also shaped more or less in rectangular cross section but the clamping lips (402) are disposed outwardly instead of inwardly so that one entire side of the channel spine (301) is open rather than merely having a slot disposed therein. As mentioned supra, outfolding configuration, such as that depicted in FIGS. 10–12, 15 and 16, requires a bulkier spine engaging assembly (307) to provide the required mating of connected parts but facilitates access to places within the spine (301). While either infolding or outfolding configuration may be employed, the latter is, therefore, preferred and is accordingly represented in all of the other drawings.

The expression "more or less" as used with reference to the spine's cross section is not intended necessarily to limit configuration to a rectangle. The structure may comprise any of a great variety of cross sections to accomplish the channel spine's (301) intended function. Channels comprising rectangular cross sections are almost universally available commercially, however, and facilitate installation by reason of their flat surfaces. They are, therefore, preferred.

Figure 10:
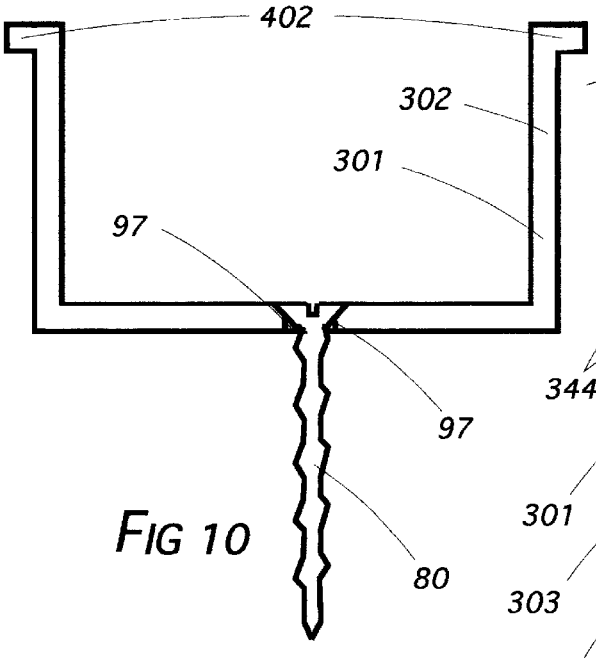
FIG. 10 is a cross sectional view of a channel spine (301) illustrating its (301) connection to a wall (106) or other supporting surface.

The channel spine's (301) attachment to a backing surface such as a wall (106) is preferably accomplished by means of screws, generally one at each end thereof (301). A wood threaded mounting fastener (80), even when run through a smooth walled fastener aperture (97) such as shown in FIG. 10, is suitable for this purpose if made to penetrate solid backing such as wooden studwork.

Each channel spine engaging assembly (307) also comprises a face (309), disposed outwardly toward the operator (200) and opposite the spine engaging underside (308), two opposing lateral sides (310), a retractable spring loaded pin latch assembly (14) and a latch spring retraction shoulder (29) both of which are further discussed ante.

The channel spine engaging assemblies (307) are so comprised that they may be employed in applications other than exercise assemblies so long as those other applications include a channel spine (301) to which the engaging assemblies' (307) undersides (308) are mated. The engaging assemblies (307), thus, comprise quick and easy means to adjust the position of any structure situated upon such channels (301).

The horizontally disposed anchoring pin (305) comprises rod-like elongation circular in cross section. Each pin emplacement socket (312) disposed in the channel spine engagement assembly (307), supra, conforms in shape to its (305) cross section. It (312) is said herein to be of size to receive the pin (305) in emplacement. The pin (305) penetrates and passes through sockets (312) disposed in each of the opposing lateral sides (310) of the spine engaging assembly (307). The pin's (305) length exceeds that between the engaging assembly's sides (310), its ends (306) extending slightly outward from each thereof (310).

Figure 17:
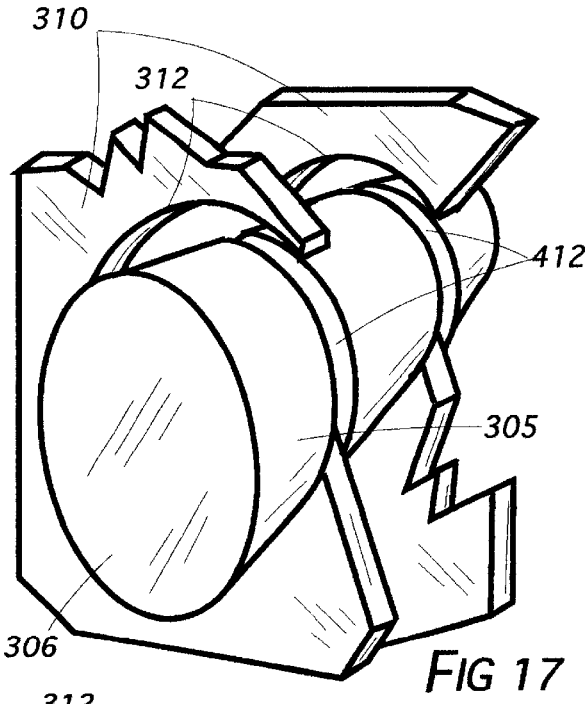
FIGS. 17 and 18 represent perspective views of an anchoring pin (305), the former thereof showing part of the spine engaging assembly (307) cut away to reveal interconnection of the pin's emplacement grooves (412) with the assembly's pin emplacement sockets (312) disposed within its lateral walls (310). The latter of the two illustrates the seating of a vertically disposed tethering hook (419) with one of the pin's tethering hook girdling grooves (420).
Figure 18:
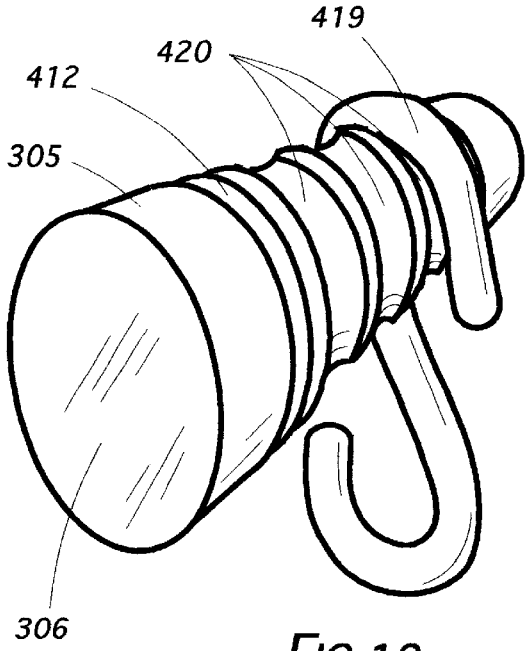
Figure 19:
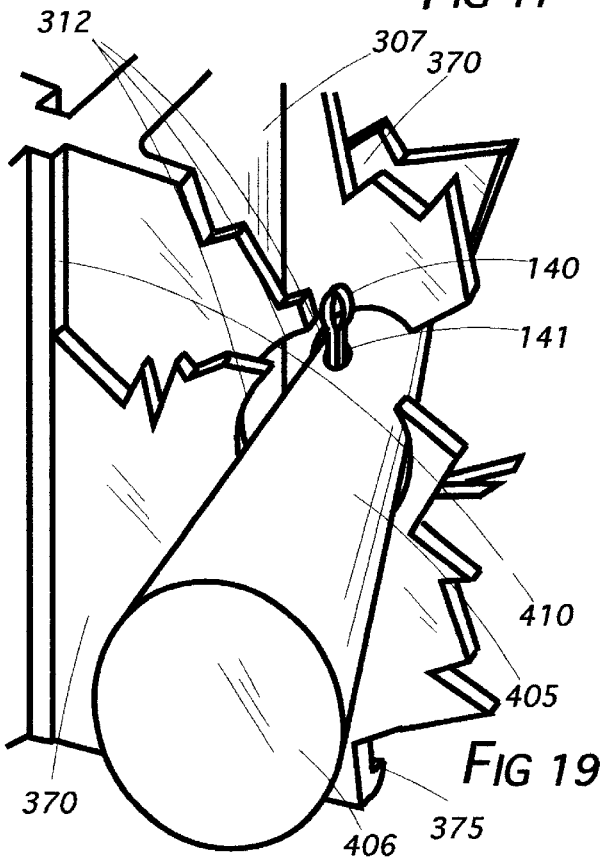
FIG. 19 comprises a cutaway perspective view of a mounting rod (405) emplaced to extend through a cantilevered tethering projection (370) and channel engaging assembly (307).

As shown in FIGS. 17–19, the anchoring pin (305) comprises an emplacement groove (412) proximate each of its ends (306). The grooves (412) loosely interconnect the circumferential edges of the pin emplacement sockets (312). The sockets (312) comprise diameter greater than that of the anchoring pin (305). The difference in diameters provides a satisfactory tolerance which facilitates the pin's (305) emplacement into the sockets (312) by the operator when setting up the apparatus. Despite this diametric tolerance, the disposition of the emplacement grooves (412) is such that the pin (305) seats, or cradles, within the sockets (312), preventing dislodgement during exercise. The depth of each groove (412) creates a gap, allowing some play to occur between the two parts (305, 312).

The gap, an inherent feature of structure, does not adversely affect the system's operation. Preferably, to provide an acceptable compromise between setup convenience and mechanical security, the diametric difference should be of the order of about 10 to 20 percent and the grooves (412) should preferably comprise depth exceeding one fourth the pin's (305) diameter. Thus, while some variation is permissible upon manufacture, if the pin (305) were of $9/16$ inch diameter, the channel engaging assembly sockets (312) could be $21/32$ inch and the groove (412) depth, $5/32$ inch. While these figures are only exemplary, they have been observed to suit the invention's needs very well.

It is generally a mounting rod (405), rather than an anchoring pin (305), which interconnects the tethering projection (70) with the spine (301). The larger diameter of the mounting rod (405) assures a snug fit with the emplacement sockets (312) disposed in both the spine engaging assembly (307) and the cantilevered projection (370). However, for one reason or another, an operator may elect to mount proximal the spine (301) a channel engaging assembly (307), which in turn requires an anchoring pin (305) there. For reasons related to the interconnection of a channel engaging assembly (307) with a cantilevered tethering projection (370), ante, it is preferable where a pin (305) is employed in lieu of the rod (405) that the pin emplacement groove (412) comprise width sufficient to accommodate double the thickness of the assembly's lateral sides (310). Consistent with the foregoing example, then, for sides (310) comprising plate thickness of $3/32$ inch, the groove (412) could measure $9/32$ inch in width, allowing some additional room for play.

In the embodiment shown in FIGS. 8 and 9, the sides (310) are shown protruding outward toward the operator (200) so as to present an irregularly shaped face (309) rather than a flat surface. The pin emplacement sockets (312) are disposed in that embodiment within those forward protruding portions of the sides (310). Such disposition permits emplacement of the pin (305) at a site which although proximate the spine (301), is nevertheless separated from it (301) enough to permit unobstructed interconnection of the pin latching assembly (14) with the latching apertures (303) and is, therefore, said to dispose the pin (305) in frontal presentment.

As an option in operator (200) assembly, a length of elastic exercise cord (27) may be tethered from a single bilateral exercise tension director (319). Alternatively, more than one thereof (319) may be emplaced upon selected anchoring pins (305) and the exercise cord (27) strung through each (319). The cord (27) is pulled outward from the invention by means of handgrips (28), foot stirrups (30) or a head and neck harness (31) disposed thereon.

Where the bilateral tension director (319) comprises a double pulley assembly (519), ante, the cord (27) is said herein to be allowed to run reciprocally through the pulleys (519) during exercise. That terminology means that as the operator (200) undertakes left and right movements of his or her body, alternatively pushing forward the left and right tension manipulators (28), the opposing one (28) and its connecting cord (27) is drawn back toward the operator tension manipulating terminal (25).

The channel spine engaging assembly's (307) adjustment in height is accomplished by manipulating a retractable spring loaded pin latch assembly (14) comprising a latch spring (16) and latch handle (18) and aperture engaging pin (15) comprising in turn a latch spring thrusting shoulder (17). Upon adjustment by the operator (200), each engaging pin (15) is sharply snapped into one of the channel spine's spaced latching apertures (303) and retained in place therein (303) by expansion of the spring (16), preferably of coiled variety. As illustrated in FIG. 9, the interior wall of the spine engaging assembly (307) is oriented to permit the spring (16) to bear against it (307) in compression as the pin (15) is withdrawn from the aperture (303). The spring's (16) expansion against the spring thrusting shoulder (17) impels the pin (15) to engage any underlying latching aperture (303) and seat itself (15) therein (303).

The thrusting force required for latching engagement occurs when the spring (16) is retracted or seated against the inner wall of the channel spine engaging assembly (307). That seating site is designated herein as a spring retraction shoulder (29). Thus, that shoulder (29) is characterized as being comprised by the channel spine engaging assembly (307), while as mentioned supra, the other seating shoulder, the thrusting one (17), is comprised by the aperture engaging pin (15). The assembly's latch handle (18), preferably comprising knob-like configuration, is shaped to provide a convenient handgrip for the operator (200) in making the adjustment. As FIGS. 8 and 9 indicate, the handle (18) is disposed along a side of the engaging assembly (307) so that when operatively pulled, it retracts the aperture engaging pin (15) from the aperture (303) along a side of the spine (301) it had theretofore been latched into.

Spring loaded latches including those which are operably retractable (14) are known in prior art, having been observed in applications including security locks for certain residential windows and in height adjustment mechanisms for some track hurdles. They are particularly useful in the invention's use in that they permit rapid adjustments to be made to a key part of the operational system. Once the adjustment has been made, the assembly (307) is held in place by rigid emplacement, as that term is employed herein.

The bilateral exercise tension director (319) mentioned supra may comprise a variety of forms. The term "bilateral" is employed herein because upon conducting exercise, tension should be directed both to the left and the right sides of the operator's (200) body. It would serve no useful purpose, for example, to tether an exercise cord (27), further discussed ante, directly to the horizontally disposed anchoring pin itself (305). While the pin's (305) configuration permits it to spin freely while seated in the pin emplacement sockets (312), exercise tension would tend to be directed in a plane perpendicular to the pin (305), only upwards and downwards, more or less vertically rather than horizontally left and right as required. Such an assembly would permit horizontal and bilateral extension only if the exercise cord (27) were awkwardly twisted across the horizontal pin (305).

It is, therefore, necessary to emplace an intermediate structure between the pin (305), on the one hand, and the exercise cord and operator tension manipulation assembly (26) further discussed ante, on the other. Such a structure must necessarily not only connect properly to the pin (305), but comprise vertical disposition as well. This disposition permits bilateral extension—that is, directs exercise tension to the left and right since the plane perpendicular to the pin (305) is thereby disposed vertically.

Any structure which is apertured on one end to allow the elastic cord (27) to slide through it during exercise and comprises means of pivotable connection to the anchoring pin (305) at the other fulfills the requirement for bilateral tension directing. Experience demonstrates that to avoid friction with the cord (27), particular attention should be paid to the connector's configuration.

Excellent results are achieved by employing the vertically disposed tethering hooks (419), mentioned supra, seated within girdling grooves (420) carved in a pin (305) dedicated for such purpose. The hook's (419) vertical orientation permits the required bilateral extension of the exercise cord (27). The hook (419) preferably comprises S shaped configuration, with one open portion of the S shape encircling the pin (305) and occupying the girdling groove (420) carved therein (305) and the other disposed to allow emplacement of the exercise cord (27).

The invention's bilateral exercise tension director (419) may comprise a double pulley assembly (519), mentioned supra, which presents an even more preferable construction, albeit a more elaborate and expensive one than the vertically disposed tethering hook (419). In fact, the most satisfactory arrangement generally results from emplacement of a double pulley assembly (519) at a locus from which the operator (200) desires to draw directional force from the exercise tethering point (300), allowing the exercise cord (27) to run therethrough (519) to simple tethering hook (419) at another locus comprising the operator tension manipulating tethering terminal (25)—that is, the ultimate tension point, supra. Such is the arrangement demonstrated in FIGS. 1–3.

As with any other exercise tension director (319), the pulley assembly (519) is engaged by a length of elastic exercise cord (27). At one of its (519) ends, the pulley assembly's tethering terminal (20) comprises an anchoring pin tethering leg (321) which in turn comprises a cylindrical tethering hinge (322) and an anchoring pin tethering leg axle pivot (23).

At the other end of the pulley assembly (519), the pulley assembly's operator tension manipulating terminal (25) comprises in part an exercise cord and operator tension manipulation assembly (26). That assembly (26) includes the length of elastic cord (27), supra, as well as an operator tension manipulator (28) which may comprise either handgrips, foot stirrups or a head and neck harness (31). A variety of straps may be employed to form connecting loops to some part of the operator (200) including the ankles or thighs for example.

A tethering leg pulley swivel (24) interconnects the pin tethering leg (321) and the pulley axle frame (32). The swivel (24) is, thus, situated intermediate the assembly's two terminals (20, 26) and permits the axle frame (32) to rotate freely while connected to the tethering leg (321).

Figure 2:
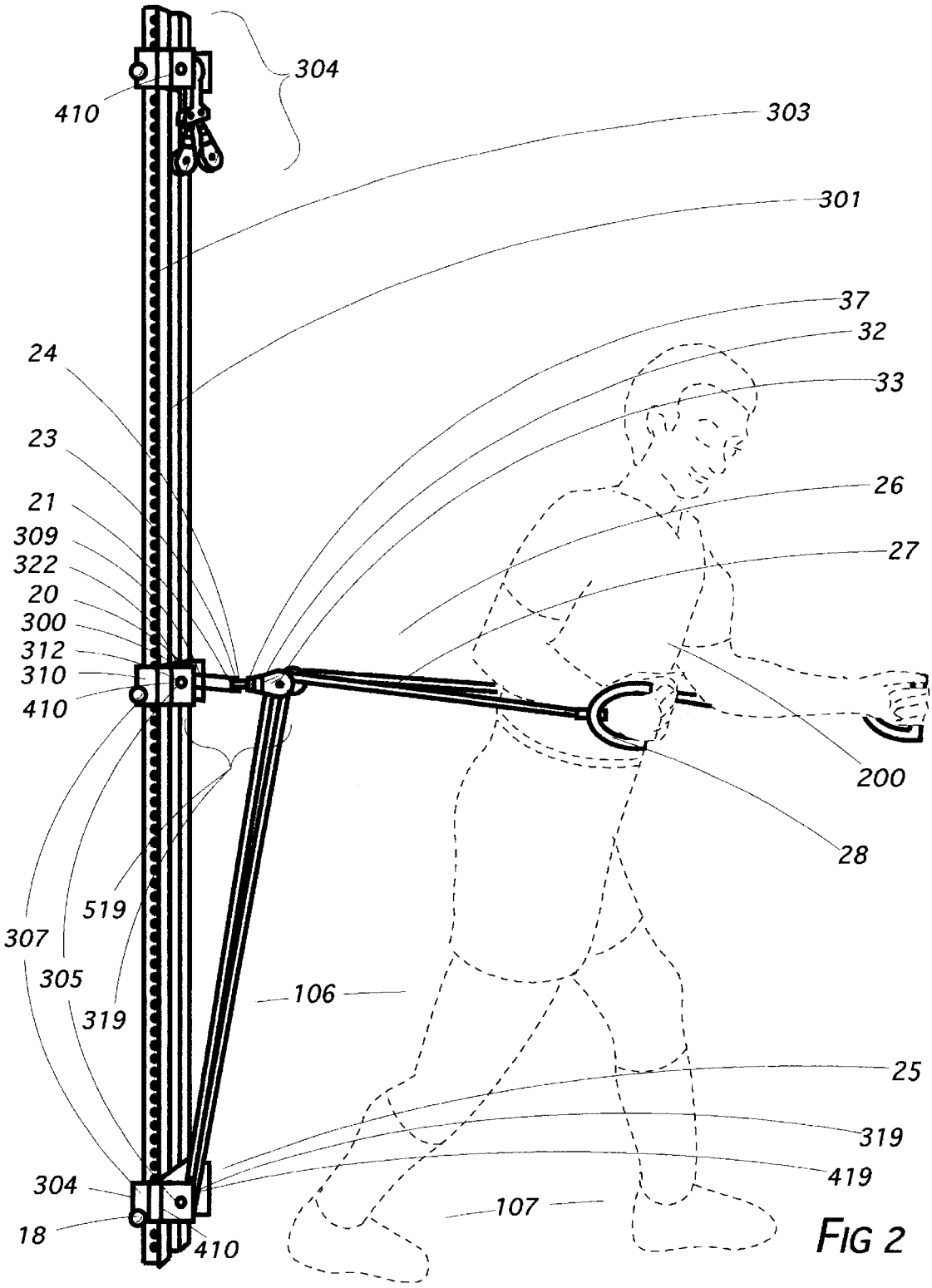
Figure 3:
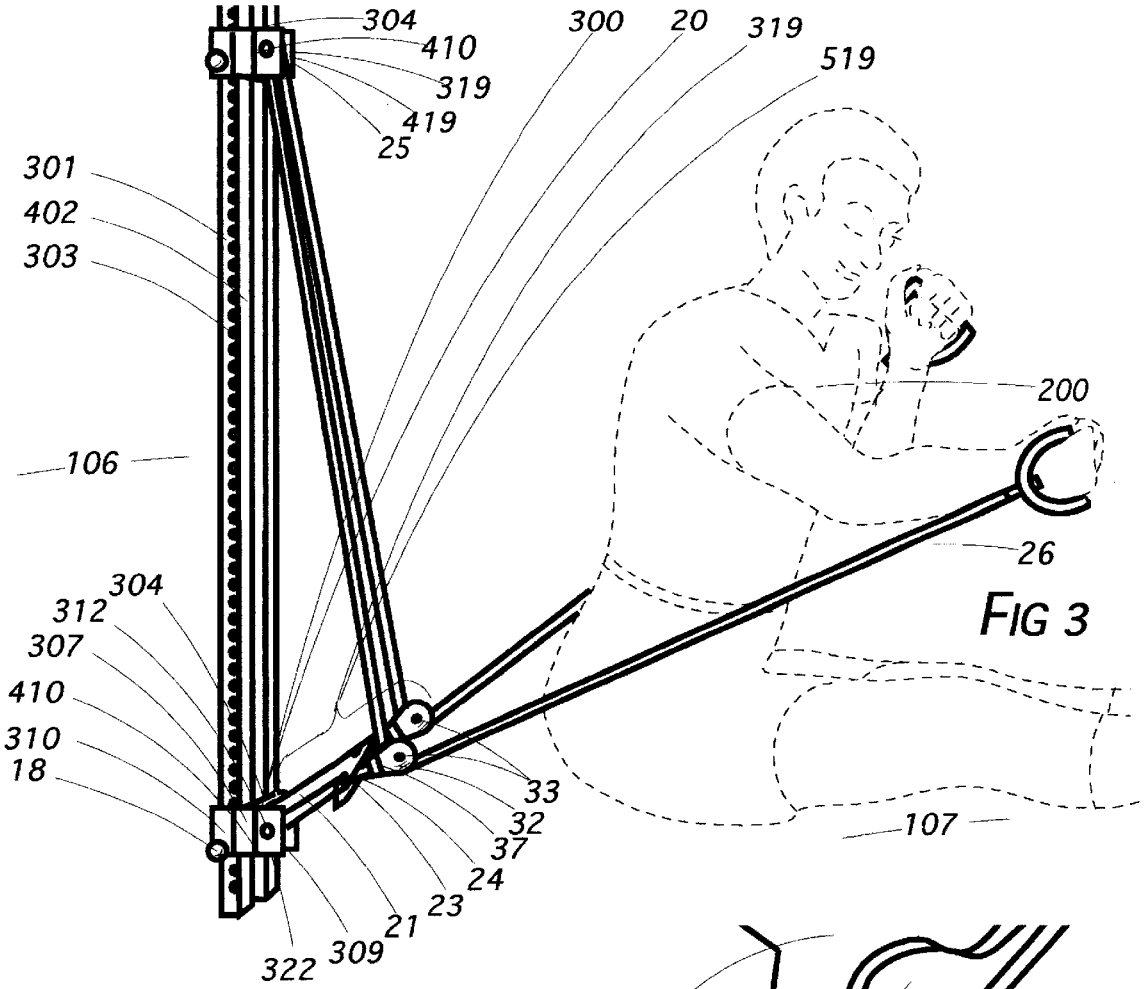
Figure 4:
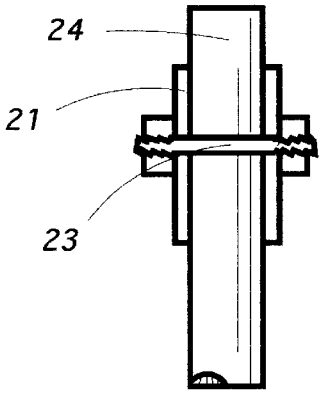
FIGS. 4 and 5 depict a tethering leg pulley swivel's (24) interconnection between an anchoring pin tethering leg (321) and a pulley axle frame (32), one view in perspective with parts of the tethering leg (321) and pulley swivel (24) cut away for viewing purposes, the other in cross section.
Figure 5:
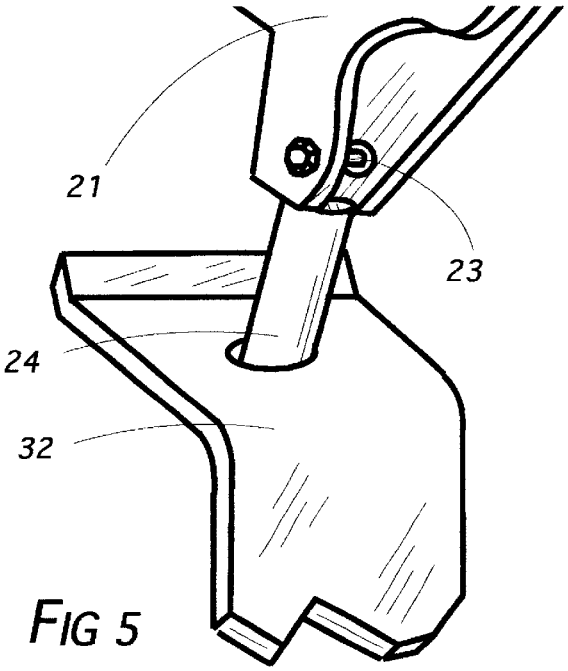

It should be recognized the pulley assembly (519) comprises four distinct axes of rotation. A first one inheres in the fact that the cylindrical tethering hinge (322) encircles and rotates freely upon the anchoring pin (305) in a vertical plane. Therefore, the assembly's tethering leg (321), with which the hinge (322) shares one-piece construction, may be oriented upwards or downwards or in any intermediate position to permit tethering selections offered by raising or lowering one or more of the channel spine engaging assemblies (307). As FIGS. 1–3 show, the tethering legs (321) point downward when the engaging assembly (307) is emplaced at a high level relative to the operator (200), upward when it (307) is emplaced at a low level and outward horizontally when emplacement is intermediate along the spine (301).

A second axis of rotation, transverse to the first, is provided at either one of two interleaf axle pivots (23), each disposed at a point on the pin tethering leg itself (321). The term Interleaf is employed because the pulley tethering leg (321) comprises parallel leaves between and transverse to which the axle pivots (23) are mounted. The distance between the leaves must accommodate the width of the pulley swivel (24). As further discussed ante, the tethering leg (321) may comprise either single leaf (421) or double leaf (521) structure.

Within certain limits, a pulley swivel (24) swings freely upon each axle pivot (23), defining a substantial part of a second plane of rotation. The axle pivots herein (23) are said to axially engage one end of the swivel (24), meaning that the swivel (24) swings freely upon the axle pivot (23).

A third axis is provided by the swivel's (24) engagement with the pulley axle frame (32). The swivel (24) passes through a hole in the frame (32). While it (24) comprises a widening at its (24) frame (32) engaging end to prevent its (24) being withdrawn from the frame (32), it (24) is configured to assure unobstructed rotation therein (32). The plane of rotation is transverse each of the others. The term axially engage is also employed with reference to this connection and has the same meaning given supra with reference to other pivot sites.

Still a fourth axis comprises the pulley wheel's (35) disposition upon its (35) own axle (33). Rotational movement at this axis is, preferably, further enhanced by configuring the axle (33) so that it (33) is permitted to rotate within the frame (32) instead of being solidly attached to it (32). This fourth axis provides an additional transverse plane of rotation. The entire assembly (519) is, thus, easily capable of reorientation in any of the three dimensions. All axes of rotation can be visualized by observing the assembly (519) depicted in FIG. 6.

Embodiments of pin tethering legs (321) are shown most clearly in FIGS. 6 and 7, although they (321) are also present in one form or another in FIGS. 1–3. That depicted in FIG. 6, comprising double leaf structure (421), permits operator (200) hand tool impingement manipulation, such as with a pair of pliers, to adjust mechanical tension upon the tethering leg pulley swivel (24) at the leg's interleaf axle pivot (23). From that point of view, it (421) is a preferred construction. However, experience has demonstrated that a pin tethering leg (321) of the single leaf configuration shown in FIG. 7 (521) can be formed by extrusion and is, therefore, more economical to manufacture. The pulley assembly's cylindrical tethering hinge (322) comprises configuration attributable to either respective structure (421, 521). Double leaf configuration (421) comprises a continuous cylindrical hinge (422) depicted in FIG. 6. Single leaf configuration (521) embodiment comprises a truncated cylindrical hinge (522) shown in FIG. 7. Whichever tethering leg (321) embodiment is presented, each (421, 521) comprises an opening to accommodate connection of the pulley swivel (24) by means of the interleaf axle pivot (23).

Optionally, any of the embodiments of the cylindrical hinge (321) may be configured so as to allow, upon pivoting or rotation, the lateral sides of the channel engaging assembly (310), supra, to pass through openings or slots within the leaf (421, 521) and cylinder itself (422, 522). Such configuration connects the cylindrical part of the structure along a greater length of the anchoring pin (305). The cylindrical structure may even enwrap the entire length thereof (305). The embodiment illustrated in FIG. 7 is so formed.

The operator tension manipulating terminal (25) of the pulley assembly (519) also comprises the pulley axle frame (32) and a pulley wheel (35) housed within it (32).

As the terminology suggests, the axle frame (32) in part comprises an axle (33) upon which the wheel (35) is axially mounted to allow it to spin.

The axle frame (32) is configured with a lateral access elastic cord emplacement gate (37), comprising an opening of width sufficient to allow passing the elastic cord (27) through it (37) when the cord (27) is operably stretched expressly for that purpose so as to narrow its (27) diameter. Once so admitted within the frame (32), the cord (27) is emplaced and seated within a circumference groove (36) comprised by the pulley wheel (35), permitting its (27) retention while circumnavigating the wheel (35) during exercise.

The pulley assembly (519) is so comprised that it (519) may be employed in applications other than exercise assemblies so long as those other applications include a horizontal anchoring pin (305) upon which its (519) tethering hinge (322) can be emplaced. The assembly's operator tension manipulating terminal (25) may address undertakings other than exercise, such as some of those encountered in industry.

While, as mentioned, the invention may be installed upon a wall (106), if desired, it lends itself well to installation upon a door's face (101) without marring the surface of the door (100). All of the wall (106) mounted exercise assembly arrangements illustrated in FIGS. 1–3 are appropriate also for door (100) mounting. In the latter case, however, additional invention elements are required.

Figure 15:
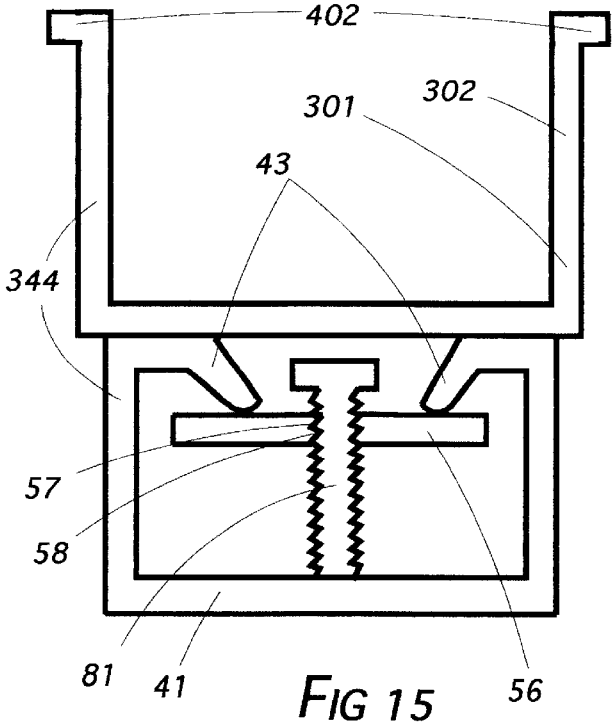
FIG. 15 is a cross sectional view of a channel frame (344) illustrating its (344) connection to a door connection bracket tongue (56) by means of a retraction bolt's (81) contact against the interior wall of the mounting channel (41) portion of the frame (344).

To that end, the invention features to complement each channel spine (301) a mounting channel (41). Such a channel (41) may take any one of several forms but, like the material employed for the channel spine (301), supra, that from which the mounting channel (41) is derived is already available commercially in very useful embodiments easily modified for a manufacturer's particular use. That (41) of the commercially available and preferable form comprises a trough or flattened "U" shape configuration, a channel spine (301) mounted atop the open part thereof (41) as shown in FIG. 15, meaning that the mounting is done such that the two structures are mutually attached longitudinally to comprise the channel frame (344). While the frame (344) may be mounted upon any vertically supporting surface such as a wall (106), its (344) use in such application is superfluous, since screws or other instruments of attachment would be employed there whether the object attached is a channel frame (344) or merely a channel spine (301).

Figure 11:
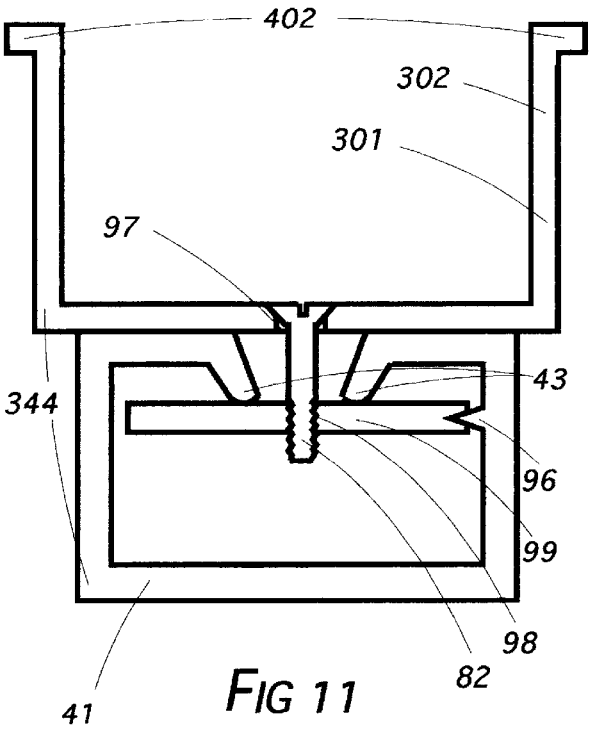
FIG. 11 is a cross sectional view of a channel frame (344) illustrating the connection of a channel spine (301) to a mounting channel (41) by means of a retraction plate (99).
Figure 12:
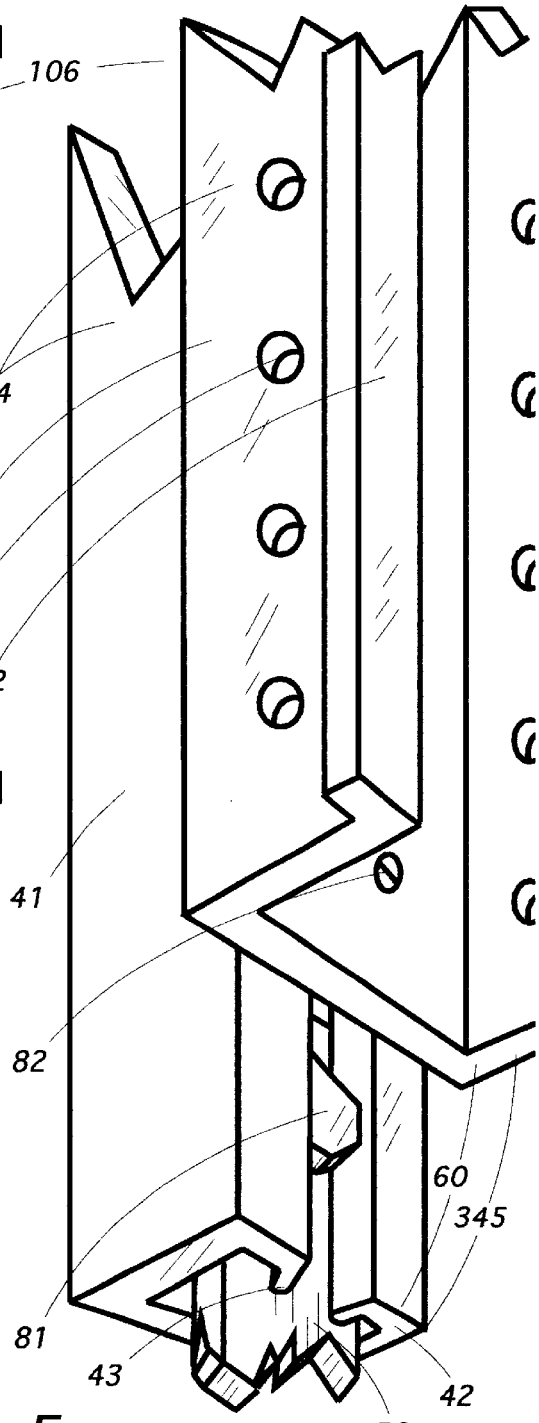
FIG. 12 is a perspective view of a channel frame end (345) showing a retraction bolt adjusting clearance (60).

The spine (301) is secured to the mounting channel (41) by means of machine threaded interconnecting fasteners (82), each of which passes through a smooth walled fastener aperture (97) disposed in the mounting channel (41) and penetrates the machine threaded interconnecting aperture (98) of a retraction plate (99). As the fastener (82) turns, the plate (99) is urged to turn with it until it contacts a turning stop (96) disposed within the mounting channel (41). Once the plate is thereby forced against the stop (96), interthreading occurs, forcing the retraction plate (99) tightly against the channel's lip ridge (343) as shown in FIG. 11.

Figure 13:
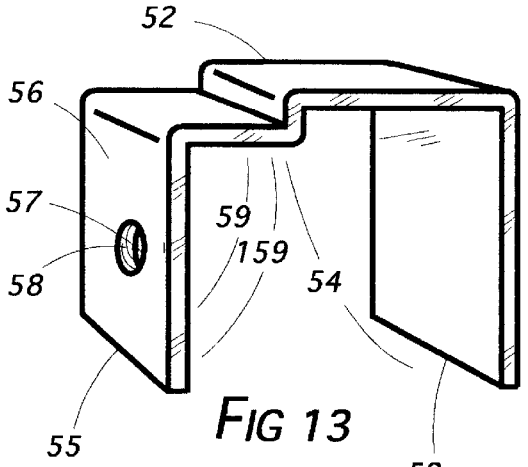
FIG. 13 comprises a perspective view of a multiply elbowed door connection bracket (52).
Figure 16:
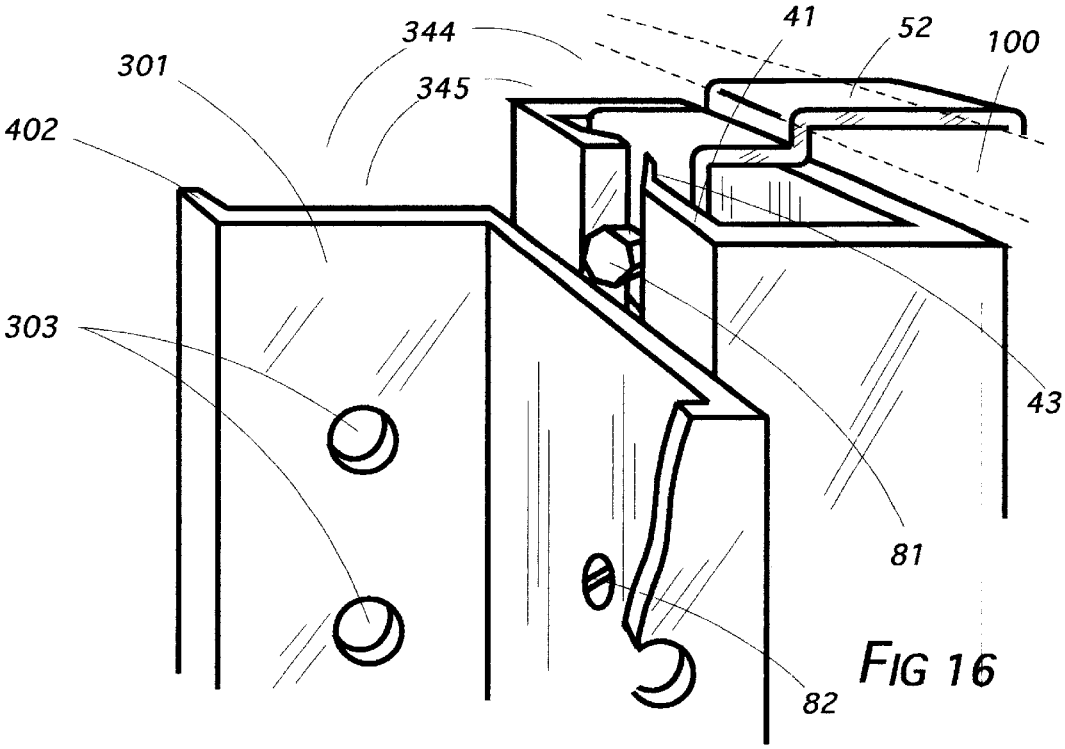
FIG. 16 comprises a perspective view of the connection site of a door connection bracket (52) of the channel frame (344) with the bracket's tongue (56).

For assembly as intended upon a door face (101), a surface protection door connection assembly (50) is employed, disposing door connection brackets (52, 152) upon the door (100), one at the top thereof (200) and the other, the bottom, respectively. The disposition is such that one (52, 152) is emplaced at either end of the channel frame (344). The uppermost bracket (52), shown in FIGS. 13 and 16, is elbowed to conform, when emplaced, snugly to the edge (102) of the door (100) at its (100) top, to provide clearance required for any millwork installed within the doorway (103) at the top. This embodiment is, therefore, stated herein to comprise doorway millwork clearance configuration (159).

Figure 14:
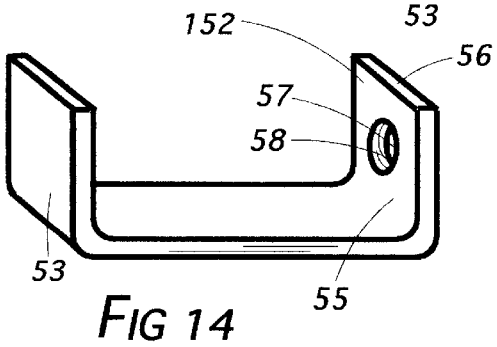
FIG. 14 represents a similar view of a straight projectioned door connection bracket (152).

Thus, the special configuration (159) is only relevant to installation of the exercise assembly upon an inwardly closing door face (101). If such millwork were absent or if installation were upon the opposite outwardly opening door face (101), two of the elbows could be omitted in manufacture and only one configuration for the bracket pair (52, 152) would be required. An embodiment comprising such less multiply elbowed configuration—or straight projectioned configuration (152), as it is referred to herein—is shown in FIG. 14 and is intended for use at the foot of the door (100), where otherwise interfering millwork is generally absent.

In fact, however, although not essential to function, the additional elbows enhance the assembly's security by reason of the additional surface thereof snugly in contact with the door (100). This observation suggests a preference that the multiply elbowed bracket (52) be employed at both of the door's (100) ends. A bracket so shaped is stated herein to comprise door edge wrapping configuration (54). Thus, the bracket depicted in FIG. 73, (52) comprises configuration both of the doorway millwork clearance (159) and the door edge wrapping (54) sort. Experience has shown that where the concern is only for the assembly's anchoring and not for millwork clearance, security is adequate without the inclusion of such a bracket (52).

Specifically, the part of the multiply elbowed bracket (52) fitting the door's edge (102) is designated the door bracketing end (53) thereof (52). As shown in the drawings, two sharp bends are required to provide it (52) with the door edge wrapping configuration (54) alluded to supra.

That bracket's (52) other end is designated the channel frame emplacement end (55). It (55) comprises a tongue (56) which upon assembly installation is extended into the mounting channel's end (42).

The tongue (56) comprises a retraction bolt aperture (57) through which a retraction bolt (81) employed to attach the channel frame (344) to the door (100) is inserted or passed. The bolt (81), thus, passes only through the tongue (56) and is then secured by retraction of its (81) threads against mated threads (56) of the tongue's aperture (57 upon the bolt's (81) inability, upon interthreading of the two (81, 58), to advance by reason of its (81) contact with the impenetrable interior wall of the channel (41) disposed proximate the door's face (101), as shown in FIG. 16. Any further urging of its (81) turning effectuates retraction. The effect, well understood in prior art, is similar to that exhibited in some drapery rod assemblies. While it would be otherwise feasible to interthread a retraction plate (99), such as that shown in FIG. 11, or even a simple nut on the side of the tongue (56) opposite the point of the bolt's entry, the retraction action illustrated in FIG. 15 obviates doing so. The latter means of firmly securing two interthreaded objects is useful in situations in which a tool's special access to a fastening site is considerably limited. By reason of the foregoing effect, the tongue (56) is retracted—or forced outward—against the interior of the mounting channel (41), fastening the channel frame (44) tightly to the door (100). A bracket shaped to accommodate installation in the foregoing manner is stated herein to comprise retraction plate configuration (59).

It is preferable that the mounting channel's lip ridge (43 comprise a curl or angular protrusion at the edge of the channel (41) the tongue (56) is urged against, as shown in FIGS. 11, 12, 15 and 16. That feature localizes the point of retraction contact, thereby strengthening the attachment.

What has been explained concerning the retaining power of the multiply elbowed bracket (52) is also true of the bracket (152) optionally employed at the bottom of the door (100). While that bracket (152) is configured with two fewer elbows than the uppermost one (52), those it (152) does comprise, nonetheless, provide the same connecting strength those of the upper bracket (52) do. Both of the two brackets (52, 152) share in comprising an elbow which upon emplacement disposes a portion of the door bracketing end (53) across the edge and against the face (101) of a household door (100) opposite that (101) of the exercise assembly's installation. It should be recognized, therefore, that the door bracketing end (53) provides a backing plate or anchor of support for the assembly.

Experience demonstrates that even where the doorway millwork mentioned supra is present, there is usually sufficient clearance for the inherent single thickness of the portion of the door bracketing end (53) disposed against the door face (101) opposite that of assembly installation. In the rare instance such should not be the case, the millwork strip would preferably be moved to provide the space required.

Since the mounting channel (41) is "U" shaped, the inwardly curled lip ridges (43) are by inherent configuration disposed to be displaced outward away from the door (100) and from the flattened innermost part of the channel (41)—the part in contact with the door's face (101). Proper retraction by the tongue (56) requires that upon insertion into the channel end (42) it (56) be disposed proximate the lip ridges (43). As shown in FIGS. 13 and 14, the bracket (52, 152) exhibits retraction plate projection configuration (59)—that is, it (52, 152) is disposed and configured to facilitate retraction, supra.

It should be apparent that in order for the bracket (52, 152) to provide the strength required to engage the ridges (43) effectively and the slight flexibility required for retractability upon interthreading, care be exercised in selecting the manufacturing materials. Many of the parts of the invention are preferably manufactured of an aluminum alloy which exhibits a pleasing shine. Because of the demands required of the door connection bracket (52, 152), however, a suitable metal is preferably employed for it (52, 152)—a stainless steel with some spring properties, for example. The commercially available mounting channel (41) itself is also comprised of steel.

The use of a surface protection door connection assembly (50) is not limited to exercise assemblies but may be employed, for example, to support various weight bearing hanger systems. It (50) may be employed in any application in which surface protective emplacement upon a door's face (101) is required, so long as a mounting channel (41) is provided.

The exercise tethering points (300) thus far provided by the foregoing assemblies supra permit tension to be applied during exercise either forward or outward from—that is, on the same generally horizontal level as—the bilateral exercise tension director (319), or angularly upwards or downwards therefrom (319). However, the invention comprises an additional optional member which permits exercise tension to be applied from tethering points (300) either more directly above or below the operator (200). To that end, there is provided a cantilevered tethering projection (370) comprising, as its (370) name suggests, an arm-like structure disposed outwardly at right angles to the supporting surface—whether door face (101) or wall (106)—providing one or more additional exercising tethering points (300).

One tethering projection (370) is generally employed with reference to a given channel spine (301), each (70) configured to permit mounting a bilateral exercise tension director (319)—typically a double pulley assembly (519)—upon it (370). The mounting site of this tension spreader (319) is outward, either at an upper overhead site or a lower one such as at foot or ankle height. The assembly (519) at the distal site includes as a member a horizontal anchoring pin (305). The projection (370) is configured to permit mounting upon a channel spine engaging assembly (307) at a site proximate the spine (301) so that the assembly's (370) height may be adjusted in the same manner as for a spine engaging assembly (307). Although an anchoring pin (305) will suffice for such purpose, as mentioned supra, anchoring of the projection (370) to the spine engaging assembly (307) at that site is preferably accomplished by means of a horizontally disposed projection mounting rod (405), which is caused to extend through opposing pin emplacement sockets (312). The engaging assembly itself (307), as mentioned supra, is anchored to the spine (301) by means of its aperture engaging pin (15).

To aid in anchoring the tethering projection (370), it (370) comprises along its (370) sides opposing embracing flanges (371), which in turn comprise the mentioned opposing pin emplacement sockets (312), further discussed ante.

Each channel engaging assembly (307) is configured with a projection shoulder (410) to accommodate the projection (370) upon emplacement. A projection's flanges (371) abut snugly against the shoulder (410) when a projection (370) is emplaced upon the engaging assembly (307) and spine (301). Such configuration together with the projection mounting rod's (405) snug fit upon interconnection with the projection's pin emplacement sockets (312) tend to lock the projection (370) in place. While some locking is also achieved when an anchoring pin (305) is employed as the interconnecting mechanism, the mounting rod (405), when used, allows for less play between parts. Although not indispensable to function, the flanges (371) also each preferably comprises a longitudinal locking ridge (375) along the lip of the projection's open portion (74). Thus, the flanges' (371) bottom edges preferably jut slightly inward toward one another (371), at least along the seating site, to enhance the fit. When included, the ridges (375) thereby add to the assembly's security. A portion of one (375) is shown in FIG. 19.

The embracing flanges (371) comprise at least two sets of pin emplacement sockets (372), one proximal and the other distal the spine (301). The sockets (312) are of the same size as those (312) comprised by the spine engaging assemblies (307). At the proximate site, the projection mounting rod (405) is inserted through the tethering projection's pin emplacement sockets (312) and the channel spine's pin emplacement sockets (312) aligned therewith (312). In one embodiment, the mounting rod (405) is elongated so that exercise gear can be hung upon it, thereby comprising it a stowage bar.

The mounting rod (405) is emplaced much on the manner an anchoring pin (305) is. However, it (405) comprises no emplacement grooves (412). Instead, security against lateral dislodgement is provided by means of a lateral stop cotter pin (140) disposed through a cotter pin aperture (141) in the rod (405) at a point between the spine engaging assembly's sides (306). Specifically, the projection (370) is so disposed upon seating that pin emplacement sockets (312) disposed in its embracing flanges (371) and through which (312) the mounting rod (405) passes are aligned with those of the spine engaging assembly (307).

Optionally, a bilateral exercise tension director's (319) tethering terminal (20) might be established at the mounting rod's (405) usual connection site. Thus, as mentioned, an anchoring pin (305) could be installed there. As also mentioned, supra, because of the double thickness provided by the conjunction of each of the engaging assembly's lateral sides (310) and a projection's flange (371), the pin's emplacement grooves (412) would have to be of more than single plate width in order to accommodate emplacement of one (305) at the site. Similarly, it would be feasible to emplace at the proximal site a pulley assembly (519) comprising a pin tethering leg (321)—even one (321) slotted with openings, discussed supra—if they were of sufficient width. The exemplary dimensions suggested supra for the anchoring pin (305) meet the double width requirement.

The projection (370) is configured as a "U" shaped channel, the closed portion of the "U" (72) disposed either upwards or downwards toward the ends of the channel spine (301) and the open portion (74), oppositely disposed toward the spine's (301) center as shown in FIG. 7. Reference is made to either end of the spine (301) herein because the projection (370) may be mounted to dispose the tethering pint (300) above the operator (200) as described or turned upside down to dispose it (300) below. Such closed portion (72) and open portion (74) orientation of the projection (370) is required to properly dispose a bilateral exercise tension director (319) such as a pulley assembly (519) upon the projector (370). The projection's "U" shaped closed portion (72) is shaped to seat snugly upon the channel spine engaging assembly (307) proximate the spine (301). The seating end of the projection (370), thus, enwraps a portion of the lateral sides (310) of the engaging assembly (307) whose face (309) projects outward toward the operator (200).

The pin emplacement sockets (312) distal the spine (301) and proximate the outermost or most forward end of the projection (370) are also aligned to permit an anchoring pin's (305) insertion therethrough, which upon complete assembly provides the desired upper or lower disposed exercise tethering points (300).

The exercise assembly also optionally comprises a stabilizing bar (90) which extends outward so that it may be gripped for bracing support by the operator (200) during certain exercises such as one solely for the legs. The stabilizing bar (90) comprises a spine engaging assembly emplacement end (91) and an operator stabilizing end (92). A handle (93) is disposed proximate the operator end (92) and preferably, for sake of simplicity and economy of manufacture, merely comprises "L" shape.

Figure 20:
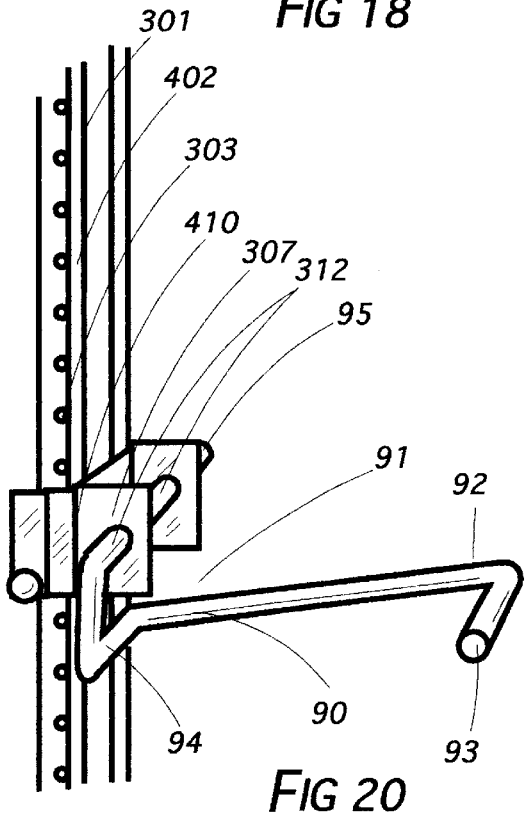
FIG. 20 is a perspective view of a stabilizing bar (90), an optional accessory, shown in engagement with a channel spine engaging assembly (307), providing operator (200) bracing security when conducting exercise.

The stabilizing bar (90) also comprises stabilization fulcrum configuration (94) such as that shown in FIG. 20, wherein a portion of the operator end (92) comprises bends which are braced against the channel spine (301) in the manner of a lever's fulcrum when the operator's weight bears upon it (90). Preferably, the fulcrum configuration (94) comprises a "C" shaped bend in the bar (90) as shown, enhancing breadth and strength as bracing means when employed. The bar (90) is configured at its channel spine engaging assembly emplacement end (91) with a spine engaging assembly emplacement finger (95), configured so that it may be inserted through the receptor's laterally disposed pin emplacement sockets (312) in the same manner as done with a horizontal anchoring pin (305), explained supra.

The inventor hereby claims:

1. An elastic cord exercising assembly comprising a vertically disposed channel spine; and at least one height adjusting channel spine engaging assembly;

at least one horizontally emplaced anchoring pin;

an operator tension manipulating assembly; and at least one bilateral exercise tension director, each connected to an anchoring pin;

the channel spine comprising a pair of opposing sides in turn comprising spaced latching apertures disposed therein along its length;

each channel spine engaging assembly comprising
- a retractable spring loaded pin latch assembly;
- a spring retraction shoulder;
- a channel spine engaging underside comprising two opposing channel spine emplacement lips mated in shape to a channel spine's cross section;
- a pair of opposing sides, comprising in turn anchoring pin emplacement sockets, each of size to receive for emplacement one of the anchoring pin's ends so as to dispose an anchoring pin in frontal presentment;

each retractable pin latch assembly comprising
- a channel spine aperture engaging pin of size to fit snugly into any one of the spine's latching apertures and comprising in turn a spring thrusting shoulder;
- a spring disposed to impel and retain the engaging pin into a channel spine latching aperture; and
- a handle attached to the pin; each horizontally disposed anchoring pin comprising a pair of emplacement grooves disposed so as to cradle within the anchoring pin emplacement sockets;

the operator tension manipulating assembly comprising
- a length of elastic cord; and
- an operator tension manipulator disposed at each of the cord's ends;

whereby upon emplacing and latching the engaging assembly upon the channel spine, the height of the assembly may operably be changed by withdrawing the aperture engaging pin from a first aperture, thereby unlatching it, compressing the spring against the retraction shoulder, repositioning the assembly to a selected height and then releasing the pin, disposing the spring to expand against the thrusting shoulder, impelling and retaining the pin into a second selected aperture, thereby latching the assembly.

2. The elastic cord exercising assembly according to claim 1 wherein one or more bilateral exercise tension directors comprise a double pulley assembly.

3. The elastic cord exercising assembly according to claim 1 wherein a bilateral exercise tension director disposed at an operator tension manipulating terminal comprises a tethering hook.

4. The elastic cord exercising assembly according to claim 1 wherein an anchoring pin inserted through the channel spine engaging assembly's emplacement sockets provides an exercise tethering point proximate the spine such that upon further connecting the bilateral exercise tension director and the operator tension manipulating assembly to the anchoring pin, an operator may engage in a variety of exercises.

5. The elastic cord exercising assembly according to claim 1 wherein the channel engaging assembly further comprises a projection abutment shoulder and the exercising assembly further comprises a cantilevered tethering projection mounted upon the engaging assembly, the projection comprising embracing flanges wherein pin emplacement sockets are disposed such that upon mounting, an opposing pair thereof are aligned with pin emplacement sockets of the spine engaging assembly and a horizontally disposed projection mounting rod inserted therethrough proximate the channel spine, interconnects the projection with the engaging assembly; and wherein a horizontally emplaced anchoring pin inserted through any other opposing pair of the flange's emplacement sockets provides an exercise tethering point distal the spine such that upon further connecting the bilateral exercise tension director and the operator tension manipulating assembly to the pin, an operator may engage in a variety of exercises not provided wherein tethering is proximate the channel spine.

6. The elastic cord exercising assembly according to claim 5 wherein each of the projection's embracing flanges further comprises a longitudinal locking ridge;

whereby the projection's security is enhanced.

7. The elastic cord exercising assembly according to claim 5 wherein the projection mounting rod comprises a lateral stop cotter pin;

whereby the rod's lateral security is enhanced.

8. The elastic cord exercising assembly according to claim 5 wherein the projection mounting rod is elongated so as to comprise a stowage bar.

9. The elastic cord exercising assembly according to claim 1 wherein each horizontally emplaced anchoring pin comprises at least one girdling groove and the bilateral exercise tension director comprises at least one tethering hook; thereby providing a simple and inexpensive tether.

10. The elastic cord exercising assembly according to claim 1 wherein the bilateral exercise tension director comprises a doubled pulley tethering assembly;

the doubled pulley tethering assembly comprising
- a pin tethering leg;
- a pair of tethering leg pulley swivels;
- a pair of pulley wheels, each disposed within a pulley axle frame;

the pin tethering leg comprising
- a tethering hinge so disposed as to pivotably enwrap an anchoring pin; and
- a pair of interleaf axle pivots, each disposed to axially engage a first end of one of the tethering leg pulley swivels;

each pulley wheel comprising a circumferential groove;

each pulley axle frame disposed to axially engage a second end of one of the tethering leg pulley swivels and comprising a pulley axle whereon one of the pulley wheels is axially disposed; and an elastic cord emplacement gate wherein the length of elastic cord is passed for emplacement within the circumferential grove of the pulley wheel;

thereby providing means by which the cord may be made to run reciprocally during the exercise so as to conserve exercise space.

11. The elastic cord exercising assembly according to claim 10 wherein the pin tethering leg comprises single leaf configuration.

12. The elastic cord exercising assembly according to claim 10 wherein the pin tethering leg comprises double leaf configuration.

13. The elastic cord exercising assembly according to claim 1 further comprising a mounting channel comprising infolding configuration, disposed by longitudinal attachment beneath the channel spine to comprise a channel frame.

14. The elastic cord exercising assembly according to claim 13 further comprising a pair of surface protection door connection assemblies, each disposed at an end of the mounting channel;

each door connection assembly comprising a threaded retraction bolt;

a door connection bracket comprising a door bracketing end configured for emplacement across the edge and against the side of a household door opposite that of the assembly's installation; and a channel frame emplacement end comprising a tongue comprising size sufficiently small to fit within the end of a mounting channel wherein it is emplaced;

an aperture comprising threads mated to those of the retraction bolt; and retraction plate projection configuration;

whereby upon mounting the channel frame vertically upon a door and securing it with the door connection assembly, an operator may engage in a variety of exercises tethered to an assembly which neither usurps otherwise unavailable wall space nor damages the door.

15. The surface protection door connection assembly according to claim 14 wherein the door bracketing end of at least one of the door connection brackets comprises door edge wrapping configuration disposed to seat snugly over the top edge of a household door;

whereby clearance required to avoid contact with otherwise present doorway millwork is provided and assembly installation security is enhanced.

16. The surface protection door connection assembly according to claim 14 wherein the door bracketing end of at least one of the door connection brackets comprises doorway millwork clearance configuration;

whereby interference of millwork structure within the doorway with the exercise assembly is avoided.

17. The elastic cord exercising assembly according to claim 1 further comprising a stabilizing bar comprising an emplacement finger disposed at a first end thereof and configured for insertion through the anchoring pin emplacement sockets of a channel engaging assembly;

a handle disposed at a second end thereof;

stabilization fulcrum configuration;

wherein the channel engagement assembly connecting end of the stabilizing bar is disposed as a brace upon the mounting channel when an operator's weight bears against it and the operator may attain additional stability while conducting certain exercises.

18. The elastic cord exercising assembly according to claim 1 wherein the distances between adjoining spaced latching apertures upon a mounting channel are equal.

* * * * *